US006305279B1

(12) United States Patent
Telkamp et al.

(10) Patent No.: US 6,305,279 B1
(45) Date of Patent: Oct. 23, 2001

(54) TOOL DRIVE APPARATUS

(75) Inventors: Arnold T. M. Telkamp, Velp; Richard G. T. Fierkens, Ewijk, both of (NL)

(73) Assignee: FiTel Innovations, Grossen (NL)

( * ) Notice: Subject to any disclaimer, the term of this patent is extended or adjusted under 35 U.S.C. 154(b) by 0 days.

(21) Appl. No.: 09/315,354

(22) Filed: May 10, 1999

(51) Int. Cl.[7] ..... B30B 1/00; B30B 15/14; B30B 1/26

(52) U.S. Cl. ..... 100/193; 100/208; 100/231; 100/291; 100/918; 100/282

(58) Field of Search ..... 100/193, 208, 100/231, 282, 226, 237, 257, 291, 918

(56) References Cited

U.S. PATENT DOCUMENTS

| | | | | |
|---|---|---|---|---|
| 4,638,731 | * | 1/1987 | Kato | 100/282 |
| 4,773,325 | * | 9/1988 | Shiokawa et al. | 100/282 |
| 4,967,586 | * | 11/1990 | Hecht | 100/282 |
| 5,467,706 | * | 11/1995 | Kato | 100/282 |
| 5,687,645 | * | 11/1997 | Kato | 100/282 |
| 5,832,816 | * | 11/1998 | Seto et al. | 100/282 |
| 6,000,298 | * | 12/1999 | Kato | 100/282 |
| 6,021,683 | * | 2/2000 | Doege et al. | 100/282 |
| 6,041,699 | * | 3/2000 | Seto et al. | 100/282 |

FOREIGN PATENT DOCUMENTS

| | | | | |
|---|---|---|---|---|
| 844611 | * | 8/1960 | (GB) | 100/208 |

* cited by examiner

*Primary Examiner*—Peter Vo
*Assistant Examiner*—Louis Huynh
(74) *Attorney, Agent, or Firm*—Weiss & Moy, P.C.; Harry M. Weiss; Jeffrey D. Moy

(57) ABSTRACT

A tool drive apparatus and method are provided which are particularly well suited for the processing of semiconductor chips on leadframe strips. The tool drive apparatus includes at least one press having a tool-receiving space, a top and bottom tool received in the tool-receiving space, and a drive unit coupled to the at least one press for asynchronous substantially vertical movement of the top tools in adjacent presses. The drive unit includes a rotatable main shaft carrying up to six cam discs each of which may be associated with a press. This arrangement permits the processing of more than one process area on a leadframe strip in the same press cycle in one tool at a time enabling the tools to be placed closer together to shorten the processing line. The tool drive apparatus may also include a latch assembly which, when activated, creates a larger tool-receiving space for repair and maintenance of the tool in one press without affecting other presses in the processing line.

16 Claims, 12 Drawing Sheets

TOOL DRIVE APPARATUS

FIELD OF THE INVENTION

This invention relates generally to cutting, trimming and forming systems for producing semiconductor devices and, more specifically, to a tool drive apparatus and method for use thereof for asynchronous operation of the system tools.

BACKGROUND OF THE INVENTION

In a production line for packaging semiconductor chips (the term "semiconductor chip" or "chips" has been used interchangeably herein with the terms "semiconductor devices" and "semiconductor packages"), a wire bonding operation is used to create wire bonds between portions of semiconductor chips and selected portions of associated leadframe strips. The output of semiconductor chips after the wire bonding operation is inputted into a molding portion or step. The molding step encapsulates semiconductor chips in plastic. The encapsulated semiconductor chips and their associated leadframe strips leaving the molding step enter a post mold curing and cool down step.

Following curing and cooling of the encapsulated semiconductor chips, a dambar cutting and debris removal step removes dambars from the leadframe strips and dislodges excess debris from the plastic housing for each of the semiconductor chips. A plating step or operation plates selected portions of the leadframe strips with a selected plating material while an off-load/on-load step is between the dambar cutting and debris removal step and the plating step. The output from the plating step is inputted into a trim and form step or operation that both removes excess portions from the leadframe strips by cutting and shapes portions of the leadframe strips by bending extended leads thereof extending from the semiconductor chips. A marking step or operation typically follows in which the plastic housing for each semiconductor chip is marked with an identification designation. The marking step may alternatively be done before the plating step. The offload section of the trim and form/marking steps or operation delivers each of the assembled and completely packaged semiconductor chips to magazines. The above steps are each typically performed by stand-alone systems. A leadframe strip may be configured to include a single row of semiconductor chips or it may be configured as a multi-row (matrix) configured leadframe strip. A process area on a leadframe strip includes one or more semiconductor chips depending on leadframe strip configuration.

Conventional processing has included a linear track along which has been positioned one press having a top press plate and a bottom press table, between which is a tool house for each tool performing a step of the process. As the leadframe strip travels along the track, the top press plate typically moves vertically opening and closing the press. The tools have disadvantageously been operated simultaneously i.e. one could not close one tool at a time because top press plate movement affects all the tools. Previously, all the packages (plastic encapsulated semiconductor chips) on one leadframe strip had to go through a first tool by moving forward one process pitch at a time before reaching a second tool. Leadframe strip transport and press movement have typically been controlled by software sequences one movement at a time.

In order to position each leadframe strip correctly within each station performing the various steps, each leadframe strip contains alignment holes that match corresponding alignment pins in the supporting equipment, with which they become engaged for proper positioning at each portion. These same alignment holes are used as the leadframe strip progresses along the track for processing. Since each step is carried out within very narrow tolerances, it is extremely important that these alignment holes, particularly the center thereof, remain in constant spatial relationship with respect to the rest of the leadframe strip. Moreover, it is important that the alignment holes are not damaged during leadframe strip transport or during positioning inside a tool. Unfortunately, the plastic molding step subjects the leadframe strip to structural and thermal stresses caused by differences in the heat expansion coefficients of the metal and the plastic material. Thus, during the cooling phase, the plastic encapsulated leadframe strip is stressed by the cooling plastic and is subjected to bending, waving and twisting of the leads as well as shrinkage causing leadframe strip pitch changes and warping or tensioning of the leadframe strips. This deformation often results in a misalignment of the alignment holes in the leadframe strip with the receiving pins in successive workstations, which causes a mismatch between the holes and the pins causing considerable quality control problems.

Because of the foregoing structural and thermal stresses, the tendency toward more precision devices with smaller dimensions, more exacting tolerances and a matrix configured leadframe strip has led to the conclusion that a leadframe strip must be processed progressively instead of at once. Moreover, each leadframe strip can be processed by only one tool at a time to prevent positioning of the leadframe strip by more than one tool.

Therefore, tools in one press should have been positioned a minimum of about 250 mm apart from each other (assuming a maximum leadframe strip length of 250 mm). However, tool accuracy worsens and production costs increase the longer the distance from tool to tool. Moreover, the amount of production floor space required by these arrangements is extensive, particularly when necessary to process a number of leadframe strips at the same time.

Accordingly, there has been a need for a novel tool drive apparatus and method to accurately process more than one process area on a leadframe strip in the same press cycle. There is an additional need for a tool drive apparatus and method that enable tools to be placed closer together than the length of a leadframe strip so as to shorten the processing line taking up only a fraction of the previously-used production floor space to lower costs and to increase accuracy and efficiency. A still further need exists for a tool drive apparatus and method that offers more processing flexibility, higher throughput, and that can be quickly and inexpensively retooled to perform different processing steps at each station to process different types of leadframe strips as well as process different semiconductor packages. There is a still further need for a tool drive apparatus and method to be used with a drive unit that operates more than one press and that only uses the force to drive the tool that has the heaviest process operation. Additionally, there is a need for a tool drive apparatus and method in which the leadframe strip can be positioned in one tool at a time. The present invention fulfills these needs and provides other related advantages.

SUMMARY OF THE INVENTION

It is an object of this invention to provide a tool drive apparatus and method to accurately process more than one process area on a leadframe strip in the same press cycle.

It is an additional object of this invention to provide a tool drive apparatus and method that enable tools to be placed closer together so as to shorten the leadframe strip processing line taking up only a fraction of the previously-used production floor space to lower costs and to increase accuracy and efficiency.

It is a still further object of this invention to provide a tool drive apparatus and method that offers more processing flexibility, higher throughput, and that can be quickly and inexpensively retooled to perform different processing steps at each station to process different types of leadframe strips as well as process different packages.

It is a still further object of this invention to provide a tool drive apparatus and method with a drive unit that operates more than one press and that only uses the force to drive the tool that has the heaviest process.

It is yet another object of this invention to provide a tool drive apparatus and method in which the leadframe strip can be positioned in one tool at a time.

The tool drive apparatus comprises, generally, at least one press having a tool-receiving space, a top and a bottom tool received in the tool-receiving space of each of the at least one press, and a drive unit coupled to the at least one press for asynchronous movement of the top tools of adjacent presses. Each of the at least one press may include a latch assembly for increasing the tool-receiving space.

The at least one press may assume either a processing position (top tool is at a position where the leadframe strip is physically processed during a press cycle) or a non-processing position (the Lop tool is at a higher position where the leadframe strip cannot be touched during a press cycle).

The at least one press includes a base block adapted to be placed on the drive unit. The base block includes a lower substantially box-like portion and an upstanding elongated portion at the rear thereof. An upper surface of the substantially box-like portion supports a stationary bottom tool table. A top tool table is separated from the bottom tool table by a plurality of guide pillars. The top tool table is physically connected and moved by a top tool lever. The top tool table moves vertically while maintaining a substantially parallel relationship to the bottom tool table.

The tool-receiving space between the bottom and top tool tables receives a tool including a bottom tool and a top tool. Each tool has a standard bottom and top set and a dedicated bottom and top product-related set. The bottom and top tools are separated by a pair of guide pillars, shorter in length than the guide pillars separating the bottom and top tool tables.

The top tool lever preferably has a generally A-shaped platform with a wide front portion and a narrower rear portion. The top tool table and top tool lever are interconnected at the front portions thereof by a lower and an upper pair of joint blocks and a pair of pivot joints.

The top tool lever extends rearwardly to a position outboard and rearwardly of the upstanding elongated rear portion of the base block. The rear end of the top tool lever is pivotally connected to an upper end of an H-beam shaped rear push rod that forms part of the latch assembly. The rear push rod extends downwardly from the top tool lever.

The latch assembly further includes an air cylinder. The air cylinder includes an upper and a lower air inlet. The air cylinder is outboard of and substantially parallel with the rear push rod. The air cylinder also includes a retractable piston rod therein, the lower end thereof connected to a latch. The latch includes an upper and lower clevis pivotally interconnected to opposite ends of a push arm back. A pair of retraction springs extends on opposite sides of the rear push rod at a position proximate the lower end of the air cylinder to an upper end of a curvewheel lever.

The at least one press is driven by the drive unit. The drive unit includes a motor coupled to a main shaft. The main shaft preferably carries up to six cam discs, each of which may be associated with a press. Of course, a greater number of cam discs and presses are within the scope of this invention. A curvewheel is resiliently urged by a compression spring to follow the associated cam disc. The curvewheel rotates the curvewheel lever causing the associated press to open and close.

The cam discs are all the same with each including a key-way. Asynchronization between adjacent presses is achieved by varying the rotational position of the cam discs relative to one another on the main shaft. The relative rotational position of the cam discs is realized by offset milling of the key slots in the main shaft i.e. the key slots of the main shaft are milled out of line. The rotational position of the cam disc driven by the main shaft determines whether the respective cam disc is in "tool-down" position or "tool-up position".

Each cam disc also has a curve or grind with a slope for fast movement (e.g. for cutting) and a slope for slow movement (e.g. for bending). The press follows the total curve of the cam disc. The height of the tool determines which point of the curve is being used as the starting point for processing the leadframe strip.

When the press is in a processing mode and the motor is driven, the main shaft will rotate causing the cam discs to likewise rotate and the curvewheel to follow causing adjacent presses to open and close asynchronously. In the processing mode, the upper and lower devises are vertically aligned with the push arm back and the piston rod is retracted into the air cylinder. The air cylinder and rear push rod are also substantially vertically aligned or upright. Therefore, in the processing mode, the latch assembly is like a "rigid" beam. The top tool lever will, during a press cycle, move between a generally horizontal position and a slightly rotated position. The rear push rod moves substantially vertically and rotates the top tool lever pushing or pulling the top tool table and associated top tool vertically. The pair of retraction springs maintains the latch assembly in this processing position.

In order to put a press into the non-processing position, the latch assembly of that press is activated by forcing air through the upper inlet of the air cylinder. The air forces extension of the piston rod from the air cylinder rotating the lower clevis downwardly and rearwardly to a collapsed position with the lower end of the rear push rod and the air cylinder becoming disposed at an outward angle to the rest of the press. As the latch assembly collapses, the top tool lever rotates quickly lifting the top tool table. The plurality of guide pillars guide the top tool table during the lift. A shock absorber substantially prevents shock and serves as the end-position when the top tool lifts quickly. The pair of retraction springs maintains the latch assembly also in the collapsed position. With the top tool out of the way in the raised position, repairs or maintenance thereon can be done without interfering with other presses. To return the press to the processing position, air is forced into the lower inlet of the air cylinder to return the latch assembly to the substantially vertically-aligned configuration.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
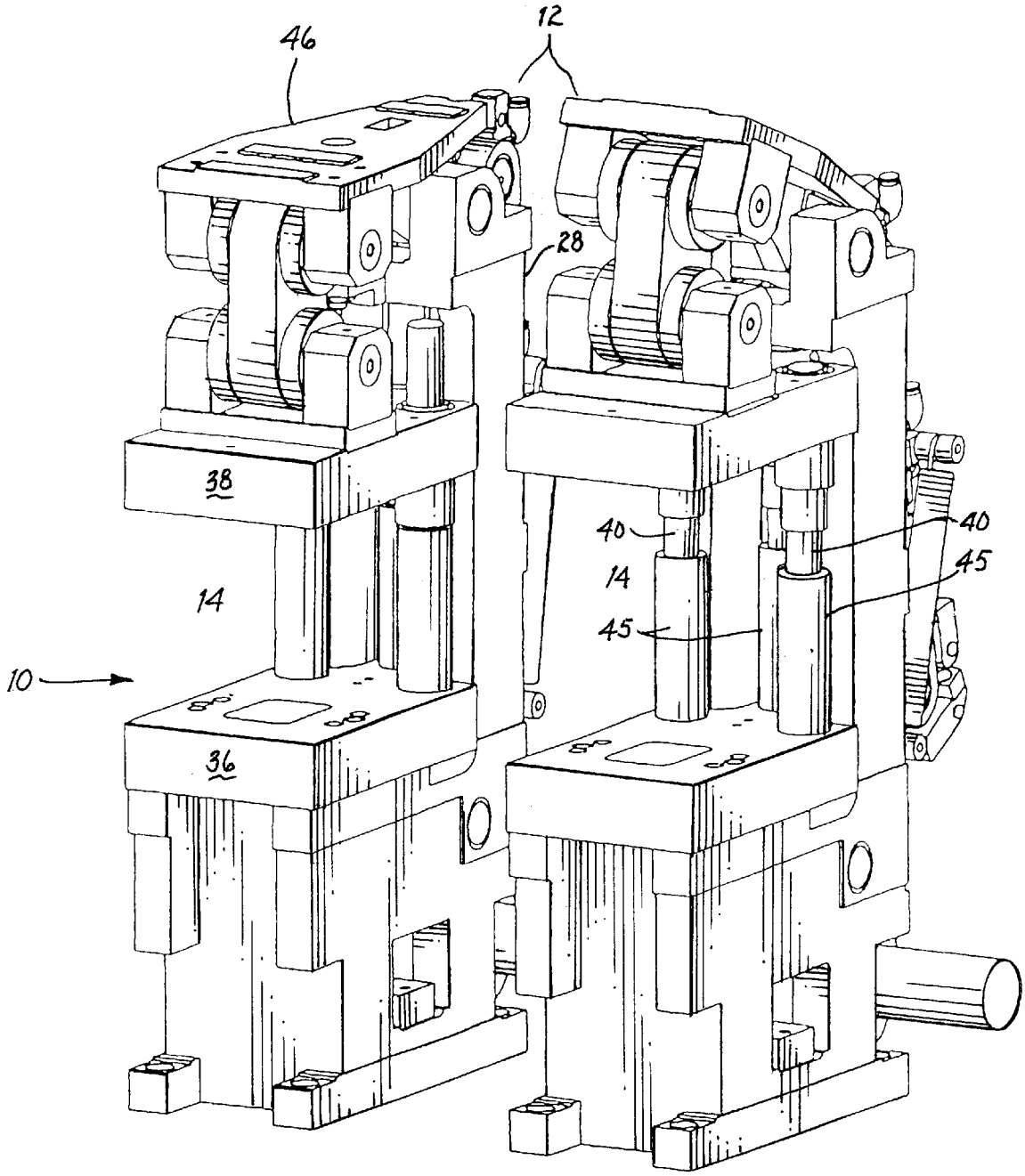
FIG. 1 is a front elevated prosepctive view of an exemplary tool drive apparatus embodying an embodiment of the present invention.

As shown in the drawings for purposes of illustration, the present invention is concerned with a tool drive apparatus and method, the apparatus generally designated in the accompanying drawings by the reference number 10. The tool drive apparatus 10 comprises, generally, at least one press 12 having a tool-receiving space 14, a top and a bottom tool 16 and 18 received in the tool-receiving space 14 of each of the at least one press 12, and a drive unit 20 (See FIG. 2) coupled to the at least one press 12 for movement of the top tools 16. Each of the at least one press 12 may include a latch assembly 22 (see FIG. 3) for increasing the tool-receiving space 14.

Figure 8:
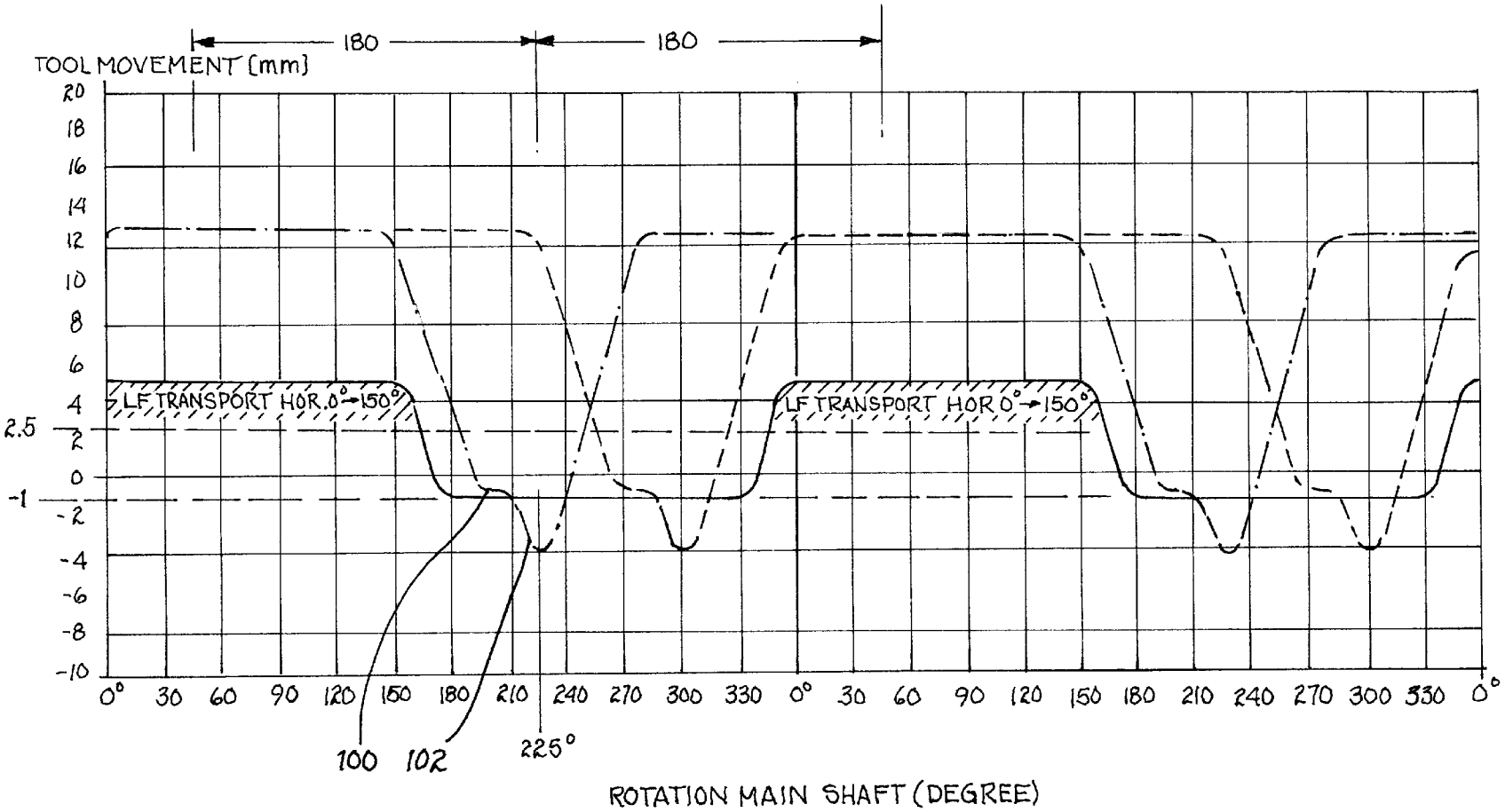
FIG. 8 is a graph illustrating asynchronous movement of top tools 1 and 3 relative to top tools 2 and 4.
Figure 9A:
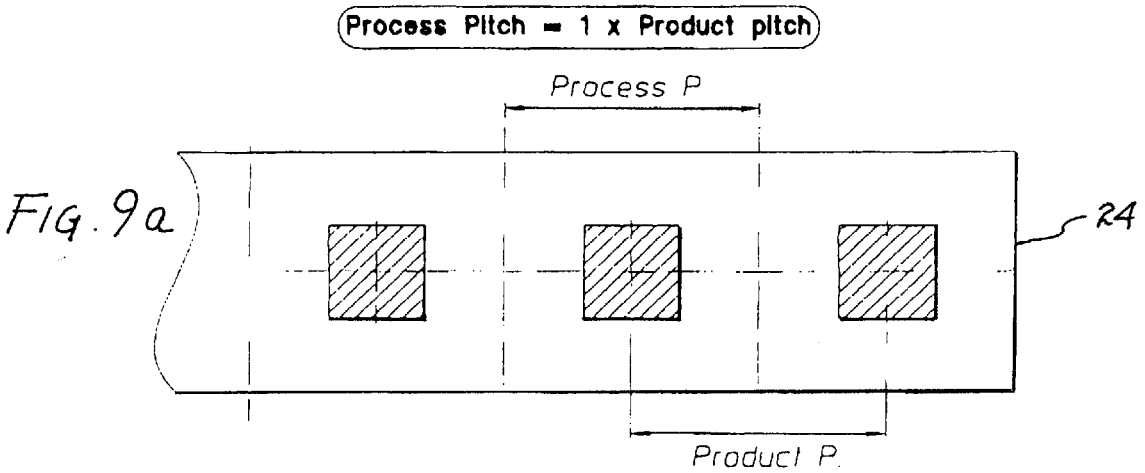
FIG. 9*a* is a top view of an exemplary leadframe strip defining the product pitch and process pitch.
Figure 9B:
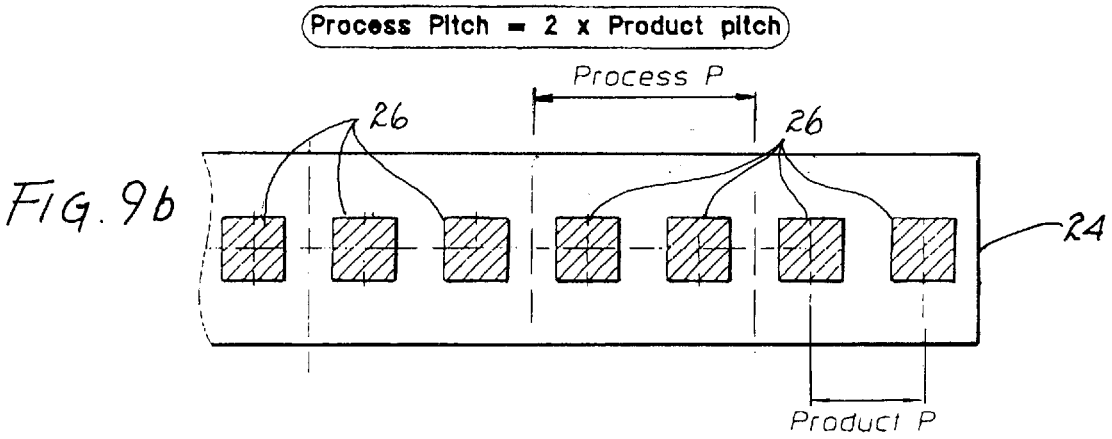
FIG. 9*b* is a top view of another exemplary single row leadframe strip having a process pitch equal to two times the product pitch.
Figure 9C:
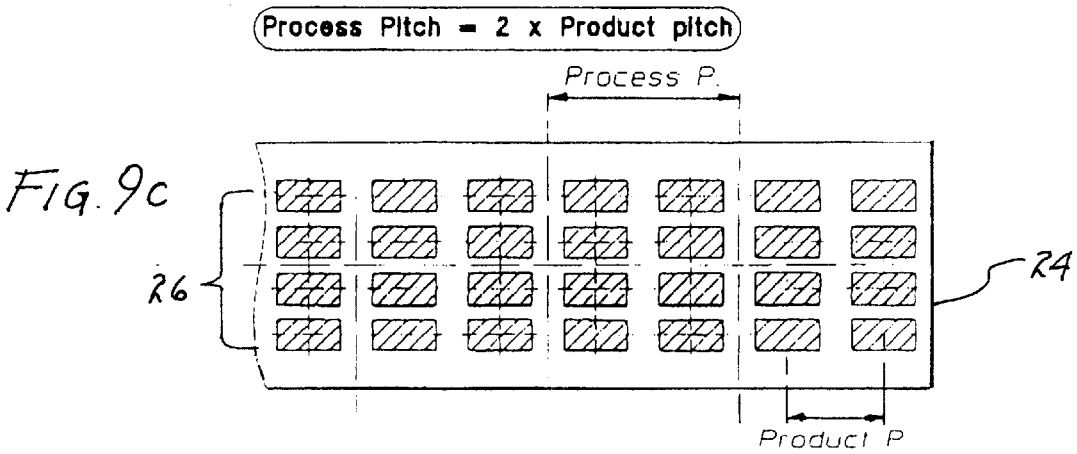
FIG. 9*c* is a top view of an exemplary multi-row (matrix) configured leadframe strip having a process pitch equal to two times the product pitch.
Figure 10:
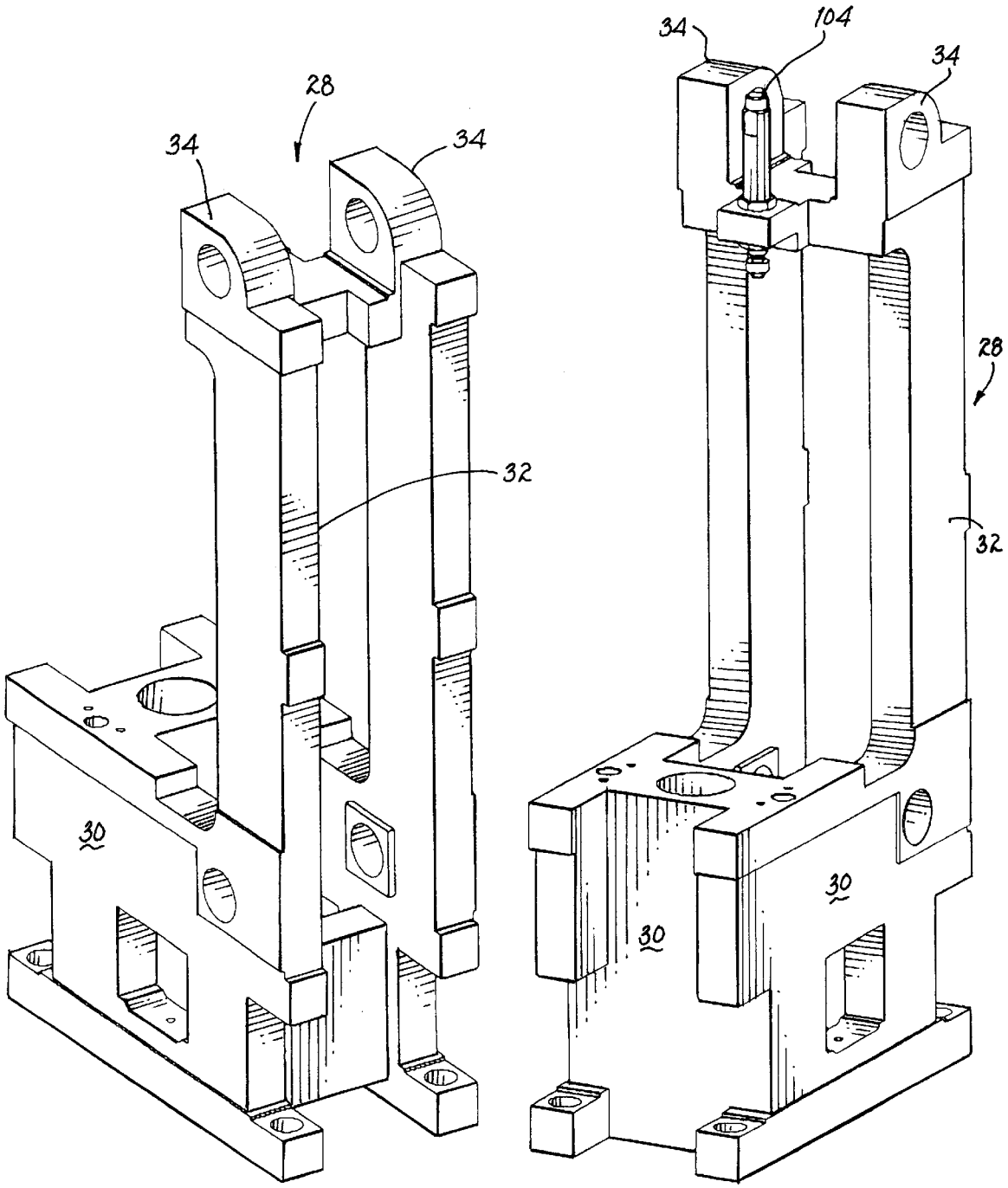
FIG. 10 is a front and rear perspective views of a base block of the press.
Figure 11:
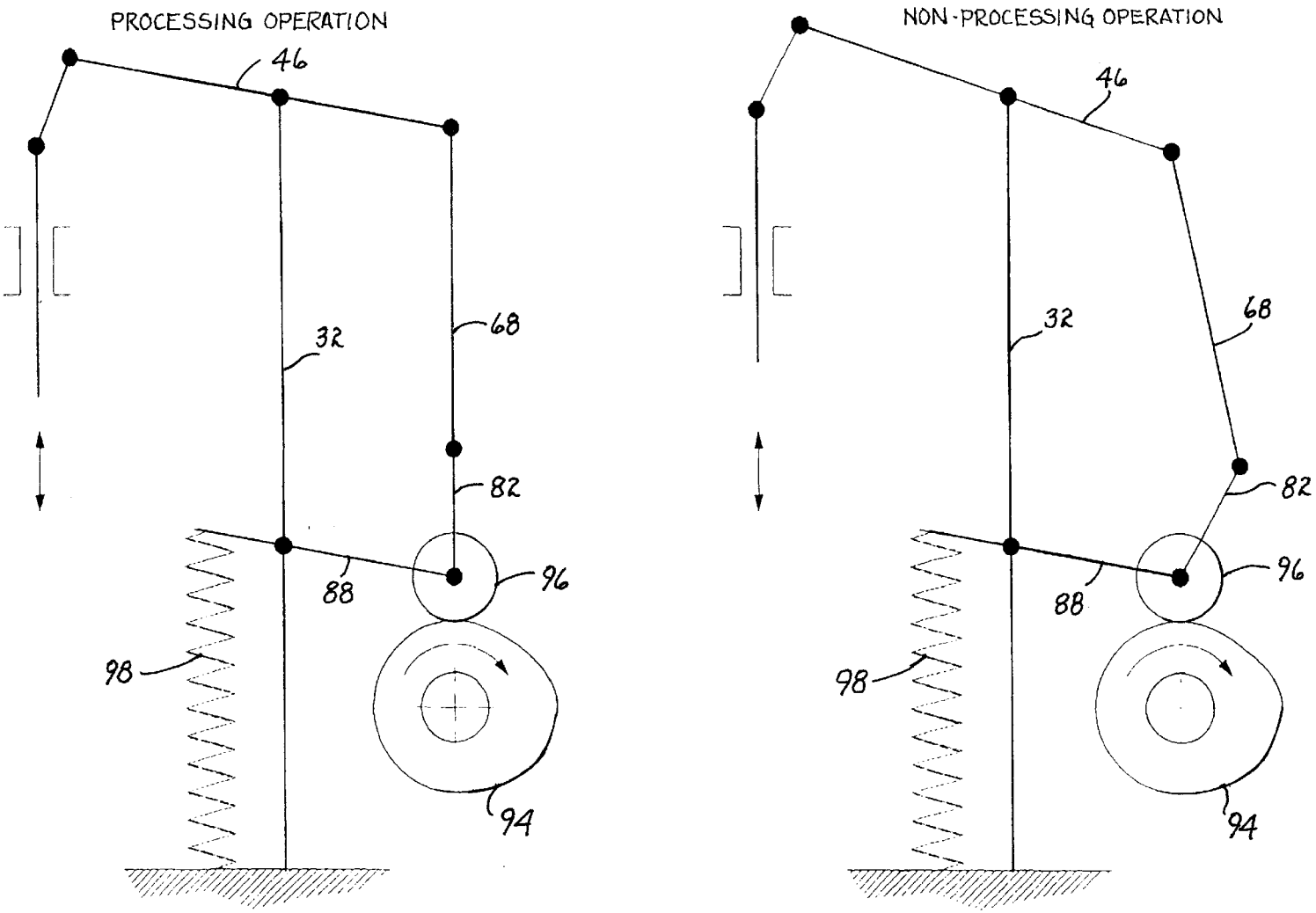
FIG. 11 is a schematic view of a press in processing and non-processing positions.
Figure 12:
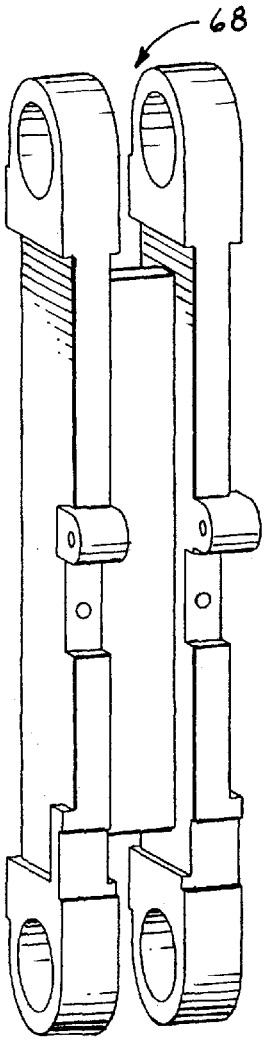
FIG. 12 is a perspective view of an H-beam shaped rear push rod.
Figure 13:
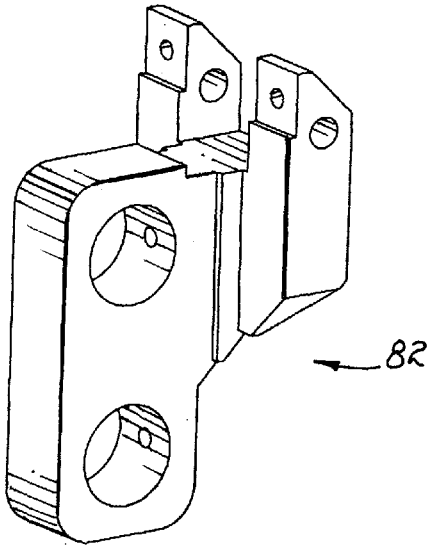
FIG. 13 is a perspective view of a lower clevis that forms part of a latch.
Figure 14:
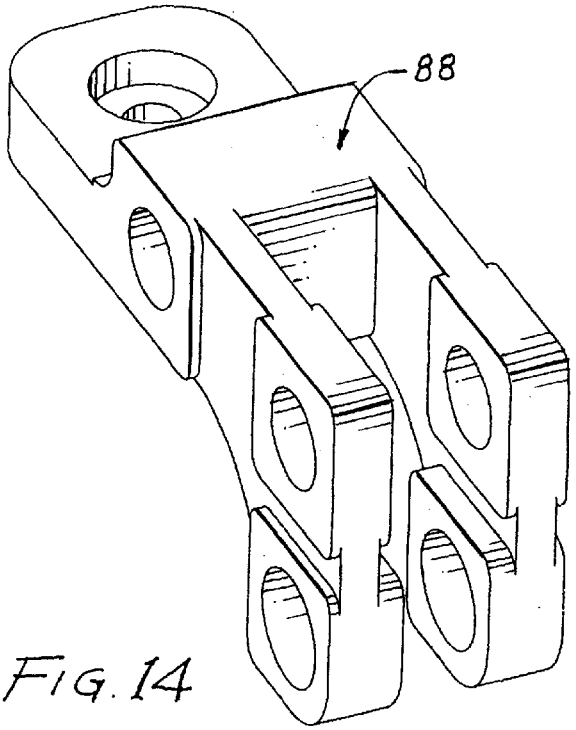
FIG. 14 is a perspective view of a curvewheel lever.

In accordance with the present invention, and as illustrated with respect to a preferred embodiment in FIGS. 1 through 14, the tool drive apparatus 10 permits each tool to have its own press movement. This arrangement permits more than one process area within one leadframe strip 24 to be processed by more than one tool in the same press cycle. The leadframe strip 24 may be a single row (FIGS. 9*a* and 9*b*) or a multi-row (matrix) configured leadframe strip 24 (FIG. 9*c*). The process area may include one or more semiconductor chips 26 depending on the size of the semiconductor chips (see FIGS. 9*a*–9*c*). The accuracy and positioning problems formerly associated with leadframe strip processing are substantially avoided and production floor space decreased as the tools can be positioned relatively close to each other. The at least one press 12 may assume either a processing position (top tool 16 is at a position where the leadframe strip 24 is physically processed) or a non-processing position (the top tool 16 is at a higher position where the leadframe strip 24 cannot be touched), as hereinafter described.

The at least one press 12 includes a base block 28 (see FIG. 10) adapted to be placed on the drive unit 20. The base block 28 includes a lower substantially box-like portion 30 and an upstanding elongated portion 32 at the rear thereof terminating at an upper end in a pair of abutments 34. An upper surface of the substantially box-like portion 30 supports a stationary bottom tool table 36.

Figure 3:
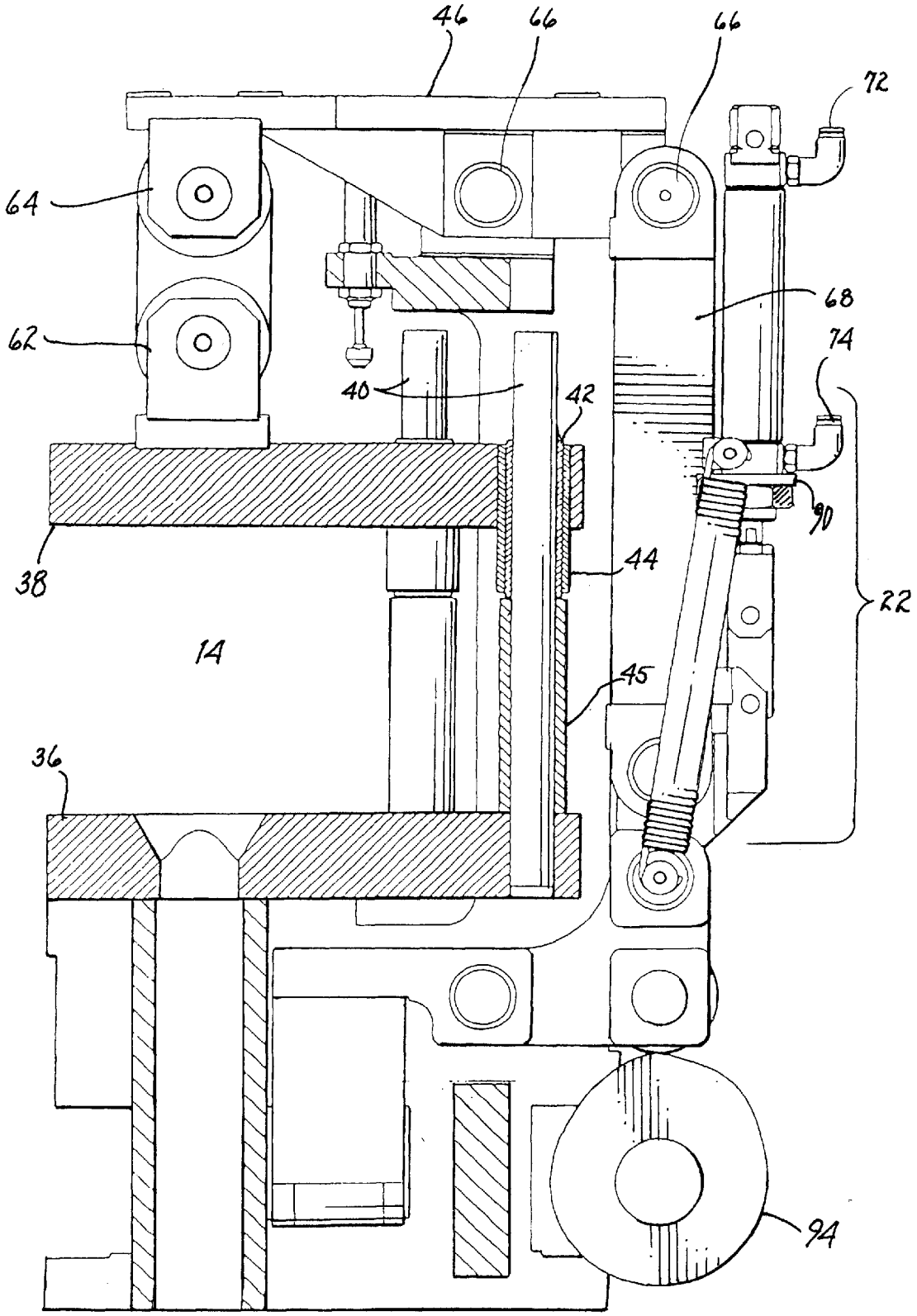
FIG. 3 is a right side elevational view (partly in cross-sectional) of the processing press shown in FIG. 1 in a compressed condition.
Figure 4:
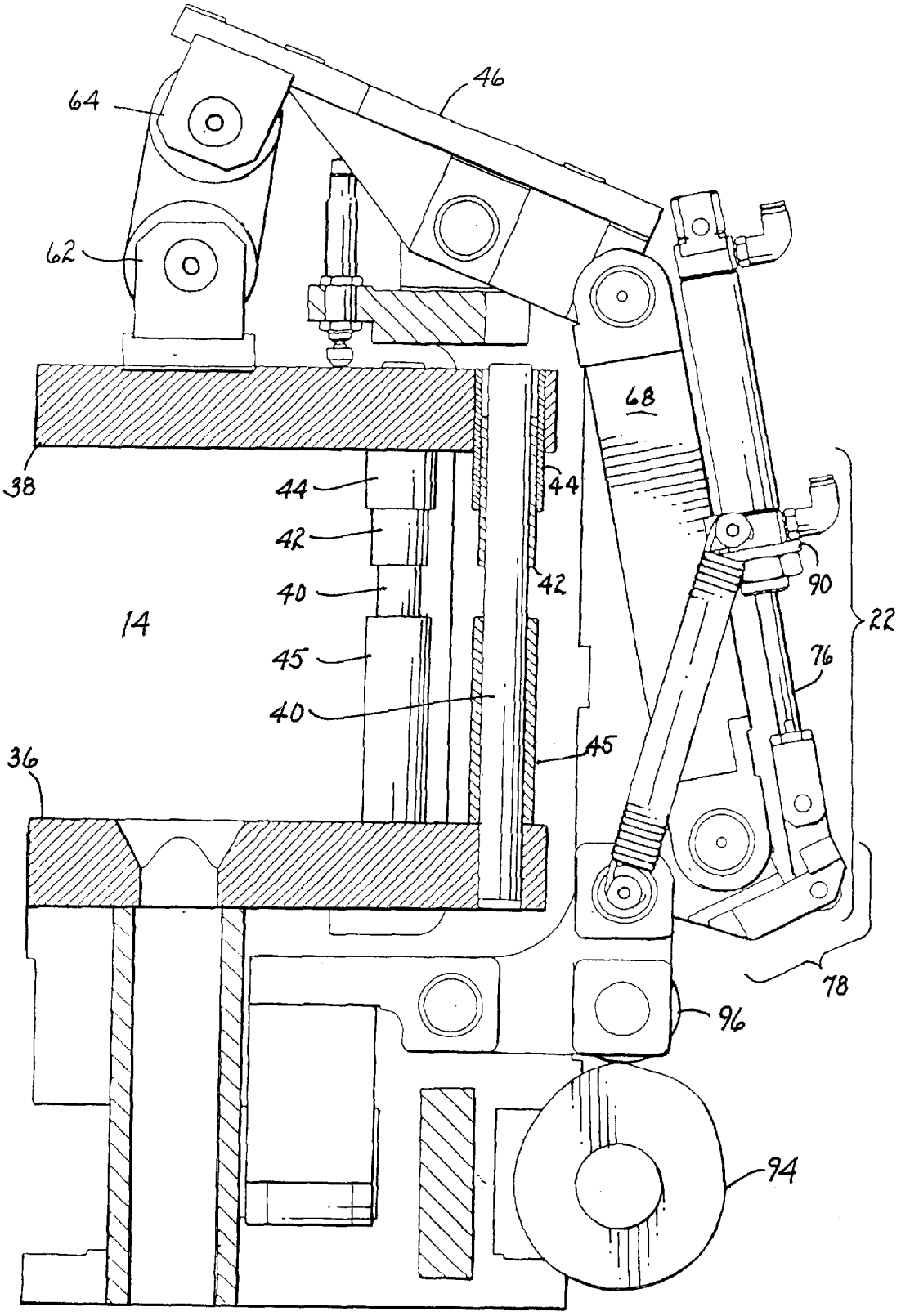
FIG. 4 is a right side elevational view (partly cross-sectional) of the tool drive apparatus of FIG. 1 in an extended position.
Figure 5:
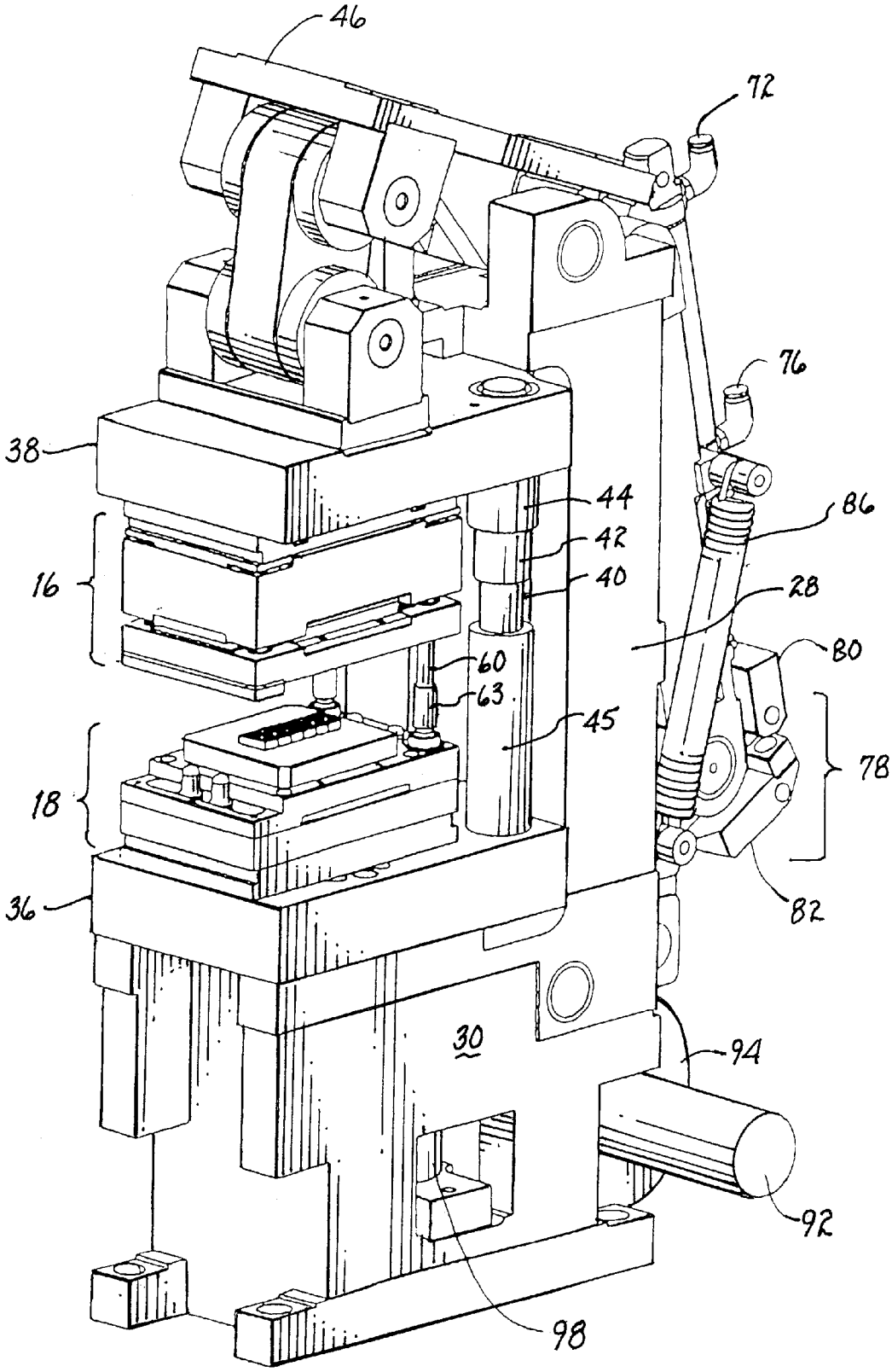
FIG. 5 is a perspective elevational view of the non-processing press including a top and bottom tool received in the tool-receiving space of the press.

A top tool table 38 is separated from the bottom tool table 36 by a trio of upstanding guide pillars 40 arranged in a triangle, each guide pillar 40 fixed at one end in a rear portion of the bottom tool table 36 and extending upwardly therefrom to a corresponding rear portion of the top tool table 38. The apex of the triangle is at the rear edge of the bottom and top tool tables 36 and 38. This arrangement permits a very rigid tool table set (in X and Y directions). Of course, it is to be understood that a greater or lesser number of guide pillars 40 may be used within the confines of the invention. As shown in FIGS. 3 and 4, the guide pillars 40 guide the top tool table by a caged ball bearing assembly 42 and a bearing raceway 44, preferably made from steel. A bushing 45, preferably made from plastic, below the bearing raceway 44 substantially prevents the caged ball bearing assembly 42 from coming out of the bearing raceway 44. The top tool table 38 is physically connected and moved substantially vertically while maintaining a substantially parallel relationship to the bottom tool table 36 by a top tool lever 46, as hereinafter described. The guide pillars 40 assist in maintaining this movement vertically accurate.

Figure 6:
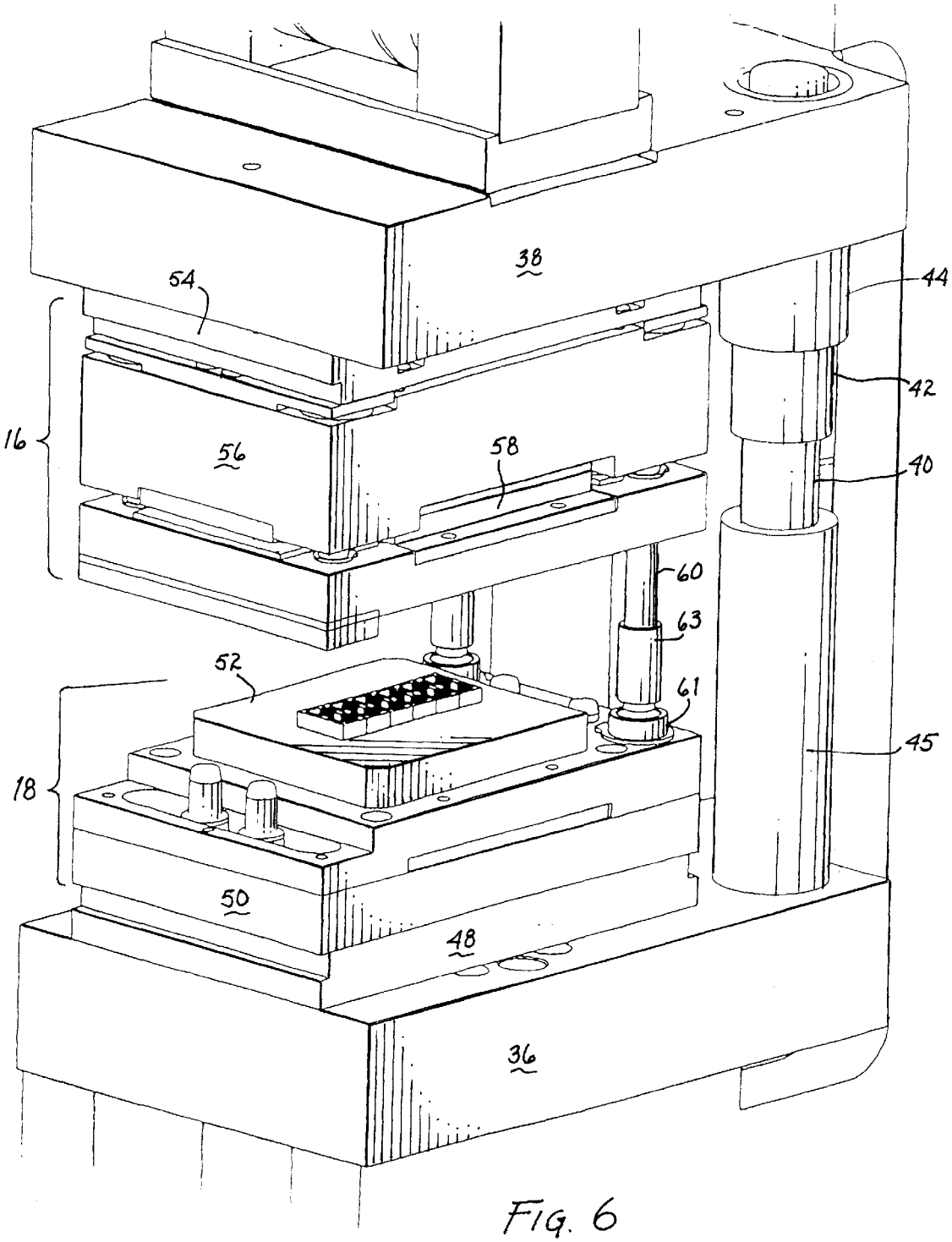
FIG. 6 is an enlarged perspective view of the tool receiving space of FIG. 5.
Figure 7:
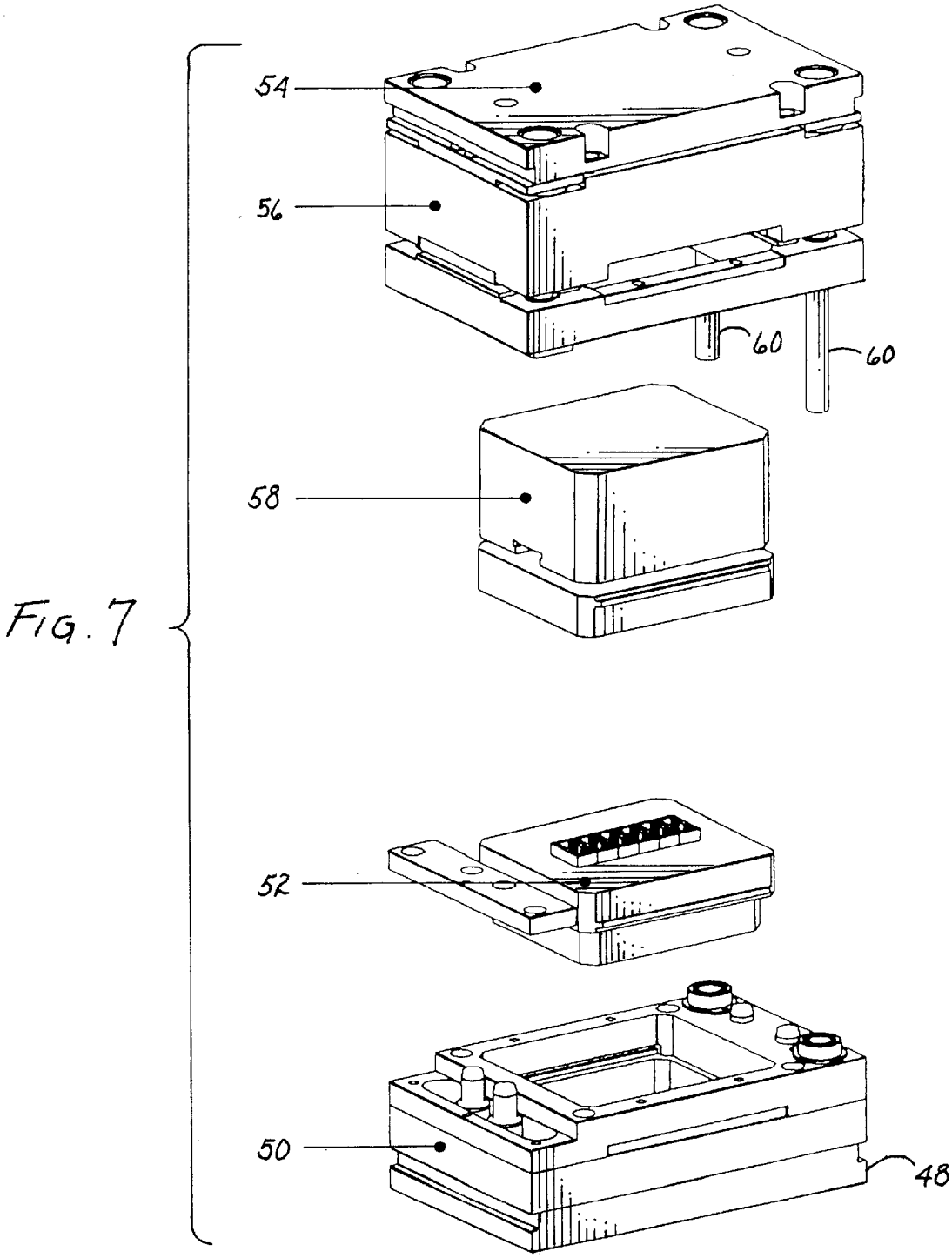
FIG. 7 is an exploded perspective assembly view of the top and bottom tools of either press.

As shown in FIGS. 6 and 7, the tool-receiving space 14 between the bottom and top tool tables 36 and 38 receives a tool including a bottom tool 18 and a top tool 16. The bottom tool 18 includes, in ascending order from the bottom tool table 36, a bottom tool adapter plate 48, a bottom tool standard set 50, and a bottom tool product-related (dedicated) set 52. From the top tool table 38, the top tool 16 includes in descending order a top tool adapter plate 54, a top tool standard set 56, and a top tool product-related (dedicated) set 58. The term "product" herein refers to a semiconductor chip, semiconductor package or semiconductor device. Each tool has these standard top and bottom sets and a dedicated top and bottom product-related set. The leadframe strips 24 are processed in the space between the bottom and top product-related sets 52 and 58. For cutting, trimming and forming systems for producing semiconductor chips, exemplary tools include a dambar cut tool, a leadframe cutting tool, a leadframe bending tool, and a singulation tool. Other tools may, of course, be used as well as other processes within the spirit of the invention.

The bottom and top tools are separated by a pair of relatively short guide pillars 60. The short guide pillars 60 are fixed in the top tool 16 in much the same manner as the Longer guide pillars 40 are fixed in the bottom tool table 36. The shorter guide pillars 60 guide the top tool by a caged ball bearing 63 and a bearing raceway 61. The term "relatively" here refers to the longer guide pillars 40. The relatively short guide pillars 60 are for accurate positioning of the top tool 16 in relation to the bottom tool 18. The top tool 16 is also floated coupled to the top tool table 38 to realize accurate positioning relative to the bottom tool. Of course, a greater or lesser number of shorter guide pillars 60 may be used within the confines of the invention.

The top tool lever 46 is a generally A-shaped platform with a wide front portion and a narrower rear portion. The top tool table 38 and top tool lever 46 are interconnected at the front portions thereof by a lower and an upper pair of joint blocks 62 and 64 with pivot bearings. The lower pair of joint blocks 62 is mounted to an upper surface of the top tool table 38. The upper pair of joint blocks 64 is mounted to a lower surface of the top tool lever 46 by a pair of pivot joints 66. The pair of pivot joints 66, with radial bearings, substantially prevents friction on the longer guide pillars 40 when the top tool table 38 is moved on the Z-axis by rotation of the top tool lever 46.

The top tool lever 46 extends rearwardly to a position outboard and rearwardly of the upstanding elongated rear portion 32 of the base block 28. The rear end of the top tool lever 46 is pivotally connected to an upper end of an H-beam shaped rear push rod 68 (FIG. 12) that forms part of the latch assembly 22. The rear push rod 68 extends downwardly from the rear end of the top tool lever 46.

The latch assembly 22 further includes an air cylinder 70 with an upper and a lower air inlet 72 and 74. The air cylinder 70 is outboard of and substantially parallel with the rear push rod 68. The air cylinder 70 also includes a retractable piston rod 16 therein, the lower end thereof connected to a latch 78. The latch 78 includes an upper and lower clevis 80 and 82 pivotally interconnected to opposite ends of a push arm back 84. A pair of retraction springs 86 extends on opposite sides of the rear push rod 68 at a position proximate the lower end of the air cylinder 70 to an upper end of a curvewheel lever 88. Each of the retraction springs 86 is mounted against opposite sides of the rear push rod 68. The bracket 90 for the air cylinder 70 is also mounted against the rear push rod 68.

The at least one press 12 is driven by the drive unit 20. Since the force to process the semiconductor chips exists for each tool at a different press moment, the drive unit 20 needs only the force for the heaviest process (usually the Dambar cut). The drive unit 20 includes a motor (not shown) coupled to a main shaft 92. The main shaft 92 is supported by a pair of bearings (not shown) and, in the preferred embodiment, carries up to six cam discs 94, each of which may be associated with a press 12. See, for example, FIG. 1 where a part of the main shaft is shown carrying three cam discs, two of which are associated with a press. Of course, a greater or lesser number of cam discs and associated cam discs are within the scope of this invention. A curvewheel 96 is resiliently urged by a compression spring 98 to follow the associated cam disc 94. The curvewheel 96 rotates the curvewheel lever 88 which causes substantially vertical movement of the lower clevis 82.

The cam discs 94 are the same, each including a key way (not shown) that fits with a key slot (not shown) in the main shaft 92. Asynchronization between the presses is achieved by varying the rotational position of the cam discs 94 relative to one another on the main shaft 92 by milling the key slots out of line along the longitudinal axis of the main shaft. The position of the key slots in the main shaft determines the rotational displacement of the cam discs relative to each other such that some tools are processing leadframe strips earlier than the other presses within a press cycle (See FIG. 8), i.e. the position of the cam disc on the main shaft determines whether the respective cam disc is in tool down or tool up position.

The presses 12 follow the total curve of the cam disc 94 but the remaining stroke after the top tool 16 has reached the leadframe strip 24 (leadframe level =0 in FIG. 8) is variable in tool speed. The height of the top tool determines which part of the cam disc 94 is used as the starting point for processing the leadframe strip 24. The same cam disc 94 can be used for several different types of tools. As illustrated in FIG. 8, the flat part of the curve 100 is for the bending tool and the steep part of the curve 102 is for the cutting tool.

When the press 12 is in processing mode and the motor (not shown) is driven, the main shaft 92 will rotate in a clockwise direction as viewed in FIG. 1 causing the cam discs 94 to likewise rotate and the curvewheel 96 to follow the cam disc 94. The curvewheel 96 rotates the curvewheel lever 88 which causes substantially vertical movement of the lower clevis 82 causing the presses 12 to open and close in a desired sequence. In processing mode, the upper and lower devises 80 and 82 are vertically aligned with the push arm back 84 and the piston rod 76 is retracted into the air cylinder 70. The air cylinder 70 and the rear push rod 68 are also substantially vertically aligned or upright. The pair of retraction springs 86 maintains the latch assembly 22 in this processing configuration. Therefore, in the processing mode, the latch assembly 22 is like a "rigid" beam (See FIG. 11). The top tool lever 46 will move between a generally horizontal position and a slightly rotated position to vertically move the top tool table 38 while maintaining a substantially parallel relationship with the bottom tool table 36. Movement of the top tool table 38 causes movement of the top tool 16.

Figure 2:
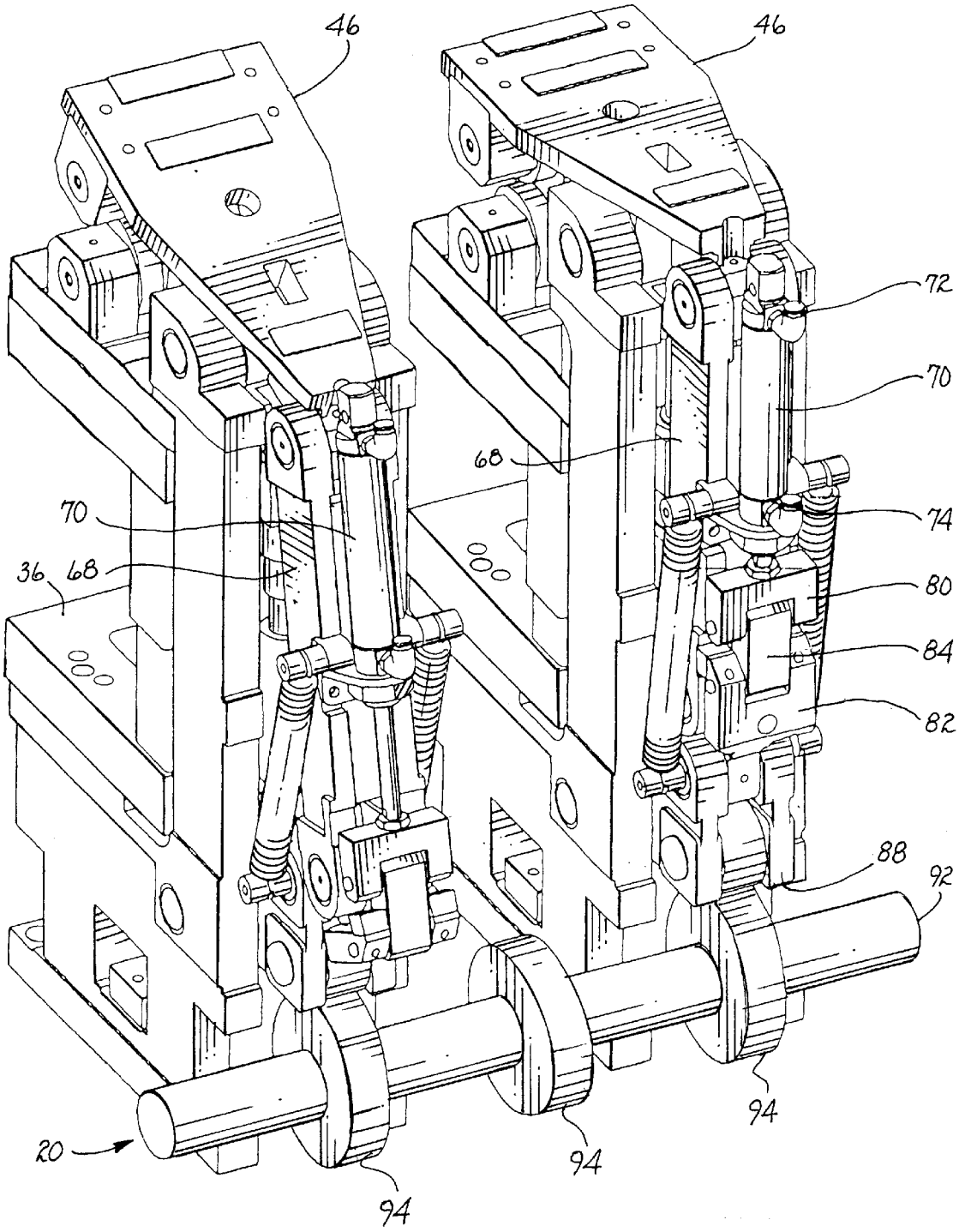
FIG. 2 is a rear view of the tool drive apparatus of FIG. 1.

The asynchronism is done between adjacent cam discs 94, so alternating top tools still operate together. With asynchronous movement of the tools rather than simultaneous movement thereof, there will not be two tools on the same leadframe strip 24 at the same time, which would pull the leadframe strip 24 prohibiting centering thereof and thus causing damage thereto. By phase displacing the moving of the top tools, the distance between adjacent tools can also be decreased, thus decreasing the length of the processing line. For example, FIGS. 1 and 2 show an exemplary two presses coupled to odd-numbered cam discs #1 and #3. Of course, in FIG. 1, it is also possible to place presses at cam discs #1 and #2, #2 and #3, or at #1, #2, and #3. If the distance between cam discs is 125 mm, the phase displacement between cam discs #1 and #3 may be zero. Cam discs two and four are phase displaced relative to cam discs one and three.

In order to put a press 12 into the non-processing position, the latch assembly 22 of that press is activated by forcing air through the upper inlet 72 of the air cylinder 70. The air forces extension of the piston rod 76 from the air cylinder 70 rotating the latch assembly 22 downwardly and rearwardly to a collapsed position with the lower end of the rear push rod 68 and the air cylinder 70 becoming disposed at an outward angle to the rest of the press (See FIG. 11). As the latch assembly 22 collapses, the top tool lever 46 rotates quickly lifting the top tool table 38 and top tool 16 out of the way. The guide pillars 40 guide the top tool table 38 via the caged ball bearing assembly 42 and bearing raceway 44 along the guide pillars 40 fixed in the bottom tool table 36. A shock absorber 104 (FIG. 10) mounted against the base block 28 above the top tool table 38 substantially prevents shock caused by the quick lifting movement and also serves as a bumper or upper end-position for the top tool table 38.

The pair of retraction springs 86 maintains the latch assembly 22 in the collapsed position.

Activating the latch assembly 22 quickly increases the tool-receiving space 14 from about 15 mm up to about 60 mm by rotating the top tool lever 46 to lift the top tool table 38 and top tool 16 away from the leadframe strip process area. Accordingly, the latch assembly is often referred to as a "quick-lift assembly". The latch assembly 22 may be activated manually or automatically, for example, by sensor (not shown) or vision camera.

For processing, the stroke must be as small as possible to overcome mass inertia forces. However, the quick-lift assembly 22 permits a larger tool-receiving space 14 to be created for visual inspection and cleaning of the tools i.e. a larger tool-receiving space makes the tools more accessible for tool exchange, repair, maintenance, etc. The cam discs 94 determine the top tool stroke (15 mm) itself—the quick-lift assembly 22 determines on what level this stroke takes place.

In addition, the quick-lift assembly 22 permits processing of a leadframe strip 24 by an adjacent press even though an affected press may be in its tool up or non-processing position due to one of the semiconductor chips 26 being defective. More specifically, if the defective semiconductor chip or chips 26 on a leadframe strip 24 is in a press, that press 12 may be placed in a non-processing position whereas the semiconductor chips in the other presses are normally processed. The affected press may be returned to processing position for further semiconductor chips following repair, for example, of the affected press. This is possible as each press 12 has a latch assembly 22 and each latch assembly is controllable and activated online during running without slowing down the system.

Once the repair, for example, has been completed, the air is forced through the lower inlet 74 returning the quick-lift assembly 22 to its substantially vertically aligned form causing the press 12 to return to its processing configuration.

Although a particular embodiment of the invention has been described in detail for purposes of illustration, various modifications may be made without departing from the spirit and scope of the invention. Accordingly, the invention is not to be limited, except as by the appended claims.

We claim:

1. A tool drive apparatus comprising, in combination:

at least one press having a tool-receiving space for receiving a tool; and a drive unit coupled to the at least one press, the drive unit including a rotatable main shaft carrying at least the same number of cam discs as presses, the at least one press having an associated cam disc assembly and a latch assembly to move the tool;

wherein the at least one press includes at least one pair of adjacent presses and the cam discs in the cam disc assemblies associated with the at least one pair of adjacent presses are carried at different rotational positions on the main shaft for asynchronous substantially vertical movement of the tools in the tool-receiving spaces of the at least one pair of adjacent presses.

2. The tool drive apparatus of claim 1, wherein the cam disc assembly includes one of the cam discs carried by the main shaft, a curvewheel and a curvewheel lever, the curvewheel following the cam disc to rotate the curvewheel lever causing movement of the latch assembly to move the tool.

3. The tool drive apparatus of claim 2, wherein the latch assembly includes an air cylinder having a retractable piston rod therein connected at a lower end to a latch comprising an upper and lower clevis pivotally connected by a push arm back, the air cylinder substantially parallel to a rear push rod pivotally connected at an upper end to a top tool lever.

4. The tool drive apparatus of claim 2, wherein the latch assembly comprises an upright beam.

5. The tool drive apparatus of claims 3 or 4, wherein the tool moves substantially vertically when the at least one press is in processing position with the latch assembly moving substantially vertically.

6. The tool drive apparatus of claim 5, wherein the tool moves from a processing position to a non-processing position by forcing air through an upper air inlet of the air cylinder to rotate the latch assembly increasing the tool-receiving space and from a non-processing position to a processing position by forcing air through a lower air inlet of the air cylinder to move the latch assembly substantially vertically, both the processing and non-processing positions maintained by a pair of springs.

7. The tool drive apparatus of claim 1, wherein the cam discs in the cam disc assemblies associated with the at least one pair of adjacent presses are carried at different rotational positions on the main shaft by fitting a plurality of key slots offset from one another along the longitudinal axis of the main shaft with corresponding key ways in the cam discs.

8. The tool drive apparatus of claim 1, wherein the tool is a top tool.

9. A tool drive apparatus comprising, in combination:

at least one press having a tool-receiving space for receiving a top tool and a bottom tool, the tool-receiving space defined by top and bottom tool tables wherein a first set of guide pillars and a second set of guide pillars are positioned between the top and bottom tool tables for guiding the top and bottom tool tables;

a top tool lever connected to the top tool table at a front portion and to a rear push rod at a rear portion;

a latch assembly including the rear push rod associated with each of the at least one press that moves the top tool lever to move the top tool; and a drive unit coupled to the at least one press including a rotatable main shaft carrying at least the same number of cam discs as presses, each of the at least one press associated with a cam disc that rotates to move the latch assembly to move the top tool lever to move the top tool.

10. The tool drive apparatus of claim 9, wherein the latch assembly is vertically aligned when the press is in processing position.

11. The tool drive apparatus of claim 10, wherein movement of the top tool lever causes the top tool table and top tool to move substantially vertically, the top tool table maintaining a substantially parallel relationship to the bottom tool table.

12. The tool drive apparatus of claim 10, wherein the press is moved to a non-processing position by forcing air through an upper inlet of the air cylinder to rotate the latch assembly to increase the tool-receiving space and move the tool to a non-processing position.

13. The tool drive apparatus of claim 9, wherein the latch assembly includes an air cylinder having a retractable piston rod therein connected at a lower end to a latch comprising an upper and lower clevis pivotally connected by a push arm back, the air cylinder substantially parallel to the rear push rod pivotally connected at an upper end to the top tool lever.

14. The tool drive apparatus of claim 9, wherein the at least one press includes at least one pair of adjacent presses and the cam discs associated with the at least one pair of adjacent presses are carried at different rotational positions on the main shaft for asynchronous substantially vertical movement of the top tools in the tool-receiving spaces of the at least one pair of adjacent presses.

15. The tool drive apparatus of claim 14, wherein the cam discs associated with the at least one pair of adjacent presses are carried at different rotational positions on the main shaft by fitting a plurality of key slots offset from one another along the longitudinal axis of the main shaft with corresponding key ways in the cam discs.

16. The tool drive apparatus of claim 9, wherein the cam discs include at least one selected grind.

* * * * *